United States Patent [19]

Jones et al.

[11] 4,122,024

[45] Oct. 24, 1978

[54] CLASSIFIED TONER MATERIALS

[75] Inventors: Lewis O. Jones, Webster; Robert Mermelstein, Rochester, both of N.Y.

[73] Assignee: Xerox Corporation, Stamford, Conn.

[21] Appl. No.: 474,487

[22] Filed: May 30, 1974

[51] Int. Cl.[2] ..... G03G 9/02

[52] U.S. Cl. ..... 252/62.1 P; 96/1 SD

[58] Field of Search ..... 96/1 SD; 252/62.1

[56] References Cited

U.S. PATENT DOCUMENTS

| | | | |
|---|---|---|---|
| 3,236,776 | 2/1966 | Tomanek | 252/62.1 |
| 3,239,465 | 3/1966 | Rheinfrank | 252/62.1 |
| 3,345,294 | 10/1967 | Cooper | 252/62.1 |
| 3,669,922 | 6/1972 | Bartsch et al. | 96/1 SD |
| 3,745,118 | 7/1973 | Brynko | 252/62.1 |

*Primary Examiner*—Roland E. Martin, Jr.
*Assistant Examiner*—John L. Goodrow

[57] ABSTRACT

Classified toner materials having a particle size number distribution with a fine index ratio of less than about 2.50, a particle size volume distribution with a coarse index ratio less than about 1.50, and a particle size distribution wherein less than about 30.0 percent by number of the toner particles have an average particle size diameter of less than about 5 microns, about 25 percnt of the particles have a diameter between about 8 microns and about 12 microns and less than about 5 percent by number of the toner particles have an average particle diameter greater than about 20 microns. The toner materials may be mixed with carrier materials to form electrostatographic developer mixtures.

16 Claims, No Drawings

CLASSIFIED TONER MATERIALS

BACKGROUND OF THE INVENTION

This invention relates in general to electrostatographic imaging systems, and, in particular, to improved developer materials and their use.

The formation and development of images on the surface of photoconductive materials by electrostatic means is well-known. The basic electrostatographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely-divided electroscopic material referred to in the art as "toner." The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is known as "cascade" development. In this method, developer material comprising relatively large carrier particles having finely-divided toner particles electrostatically clinging to the surface of the carrier particles is conveyed to and rolled or cascaded across the electrostatic latent imagebearing surface. The composition of the toner particles is so chosen as to have a triboelectric polarity opposite that of the carrier particles. In order to develop a negatively charged electrostatic latent image, an electroscopic powder and carrier combination should be selected in which the powder is triboelectrically positive in relation to the carrier. Conversely, to develop a positively charged electrostatic latent image, the electroscopic powder and carrier should be selected in which the powder is triboelectrically negative in relation to the carrier. This triboelectric relationship between the powder and carrier depends on their relative positions in a triboelectric series in which the materials are arranged in such a way that each material is charged with a positive electrical charge when contacted with any material below it in the series and with a negative electrical charge when contacted with any material above it in the series. As the mixture cascades or rolls across the imagebearing surface, the toner particles are electrostatically deposited and secured to the charged portions of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharge background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic images is the "magnetic brush" process as disclosed, for example, in U.S. Pat. No. 2,874,063. In this method a developer material containing toner and magnetic carrier particles is carried by a magnet. The magnetic field of the magnet causes alignment of the magnetic carriers in a brush-like configuration. This "magnetic brush" is engaged with an electrostatic latent imagebearing surface and the toner particles are drawn from the brush to the electrostatic image by electrostatic attraction. Many other methods such as "touchdown" development as disclosed by C. R. May in U.S. Pat. No. 2,895,847 are known for applying electroscopic particles to the electrostatic latent image to be developed. The development processes as mentioned above, together with numerous variations, are well-known to the art through various patents and publications and through the widespread availability and utilization of electrostatographic imaging equipment.

In automatic electrostatographic equipment, it is conventional to employ an electrostatographic plate in the form of a cylindrical drum which is continuously rotating through a cycle of sequential operations including charging, exposure, developing, transfer and cleaning. The plate is usually charged with corona with positive polarity by means of a corona generating device of the type disclosed by L. W. Walkup in U.S. Pat. No. 2,777,957 which is connected to a suitable source of high potential. After forming a powder image is electrostatically transferred to a support surface by means of a corona generating device such as the corona device mentioned above. In automatic equipment employing a rotating drum, a support surface to which a powdered image is to be transferred is moved through the equipment at the same rate as the periphery of the drum and contacts the drum in the transfer position interposed between the drum surface and the corona generating device. Transfer is effected by the corona generating device which imparts an electrostatic charge to attract the powder image from the drum to the support surface. The polarity of charge required to effect image transfer is dependent upon the visual form of the original copy relative to the reproduction and the electroscopic characteristics of a developing material employed to effect development. For example, where a positive reproduction is to be made of a positive original, it is conventional to employ a positive polarity corona to effect transfer of a negatively charged toner image to the support surface. When a positive reproduction from a negative original is desired, it is conventional to employ a positively charged developing material which is repelled by the charged areas on the plate to the discharge areas thereon to form a positive image which may be transferred by negative polarity corona. In either case, a residual powder image and, occasionally, carrier particles remain on the plate after transfer. Before the plate may be reused for a subsequent cycle, it is necessary that the residual image and carrier particles, if any, be removed to prevent ghost images from forming on subsequent copies. In the positive-to-positive reproduction process described above, the residual developer powder, as well as any carrier particles present, are tightly retained on the plate surface by a phenomenon that is not fully understood but believed caused by an electric charge. The charge is substantially neutralized by means of a corona generating device prior to contact of the residual powder with a cleaning device. The neutralization of the charge enhances the cleaning efficiency of the cleaning device.

Typical electrostatographic cleaning devices include the "web" type cleaning apparatus as disclosed, for example, by W. P. Graff, Jr., et al in U.S. Pat. No. 3,186,838. In the Graff, Jr., et al patent, removal of the residual powder and carrier particles on the plate is effected by rubbing a web of fibrous material against the imaging plate surface. These inexpensive and disposable webs of fibrous material are advanced into pressure and rubbing or wiping contact with the imaging surface and are gradually advanced to present a clean surface to the plate whereby substantially complete removal of the residual powder and carrier particles from the plate is effected.

While ordinarily capable of producing good quality images, conventional developing materials suffer serious deficiencies in certain areas. Some developer materials, though possessing desirable properties, such as proper triboelectric characteristics, are unsuitable because they tend to cake, bridge, and agglomerate during handling and storage. The developing materials must flow freely to facilitate accurate metering and even distribution during the development and developer recycling phases of the electrostatographic process. Adherence of carrier particles to reusable electrostatographic imaging surfaces causes the formation of undesirable scratches on the surfaces during the image transfer and surface cleaning steps. In addition, the triboelectric values of some developer materials fluctuate with changes in relative humidity and, therefore are not desirable for employment in electrostatographic systems, particularly in high-speed automatic machines which require developer materials having stable and predictable triboelectric values. Another factor affecting the stability of the triboelectric properties of developer materials is the susceptibility of developer particles to "toner impaction." When developer particles are employed in automatic machines and recycled through many cycles, the many collisions which occur between the carrier particles and other surfaces in the machine cause the toner particles carried on the surface of the carrier particles to be welded or otherwise forced onto the carrier surfaces. The gradual accumulation of impacted toner material on the surface of the carrier causes a change in the triboelectric value of the carrier and directly contributes to the degradation of copy quality by eventual destruction of the toner carrying capacity of the carrier.

Thus, there is a continuing need for a better developer material for developing electrostatic latent images.

SUMMARY OF THE INVENTION

It is, therefore, an object of this invention to provide developer materials which overcome the above noted deficiencies.

It is another object of this invention to provide developer materials which are more resistant to agglomeration and have improved dispensing characteristics.

It is yet another object of this invention to provide developer materials having more stable electrostatographic properties.

It is yet another object of this invention to provide developer materials which have a longer developer life.

It is yet another object of this invention to provide developer materials which are less susceptible to toner impaction.

It is yet another object of this invention to provide developer materials which are more resistant to film formation on electrostatographic recording surfaces.

Another object of this invention is to provide developer materials which exhibit improved electrical and mechanical properties useful in an electrostatographic apparatus employing magnetic brush development apparatus.

A still further object of this invention is to provide improved developer materials having physical and chemical properties superior to those of known developer materials.

The above objects and others are accomplished, generally speaking, by providing electrostatographic developer materials comprising classified toner materials having a particle size number distribution with a fine index ratio of less than about 2.50, a particle size volume distribution with a coarse index ratio less than about 1.50, and a particle size distribution wherein less than about 30.0 percent by number of the toner particles have an average particle size diameter of less than about 5 microns, about 25 percent of the particles have a diameter between about 8 microns and about 12 microns and less than about 5 percent by number of the toner particles have an average particle diameter greater than about 20 microns. The term coarse index is defined as the ratio of the volume distribution of particle size diameter of 84 percent of the particles divided by the particle size diameter of 50 percent of the particles. Similarly, the term fine index is defined as the ratio of the number distribution of particle size diameter of 50 percent of the particles divided by the particle size diameter of 16 percent of the particles. Both the coarse index and fine index ratios are calculated from the respective volume and number cumulative frequency plots which are obtained from particle size analysis performed on a Coulter Counter employing a 100 micron orifice. The former value represents the median or average particle size distribution by weight or volume of the toner particles and has an important influence on the copy quality obtained in an electrostatographic development system. The fine index is a measure of the toner particles number average distribution, weighted on the fine end, and has an important reflection on the measure of the useful lifetime of the developer, the systems life, rate of photoreceptor filming and rate of toner impaction on the electrostatographic recording surface.

It has been found that the classified toner materials of this invention provide satisfactory results when the particle size number distribution fine index thereof is less than about 2.50. Improved results are obtained with, and it is preferred, that the particle size number distribution fine index thereof is less than about 2.00. Optimum results are obtained when the particle size number distribution fine index of the classified toner materials of this invention is less than about 1.45. Similarly, satisfactory results are obtained with the classified toner materials of this invention when the particle size volume distribution coarse index thereof is less than about 1.50. However, it is preferred that the particle size volume distribution coarse index thereof be less than about 1.45 because improved resolution and edge definition is obtained on the copies. Optimum results are obtained when the particle size volume distribution coarse index of the classified toner materials of this invention is less than about 1.35.

In addition, it has been found that the classified toner materials of this invention provide satisfactory results when the particle size distribution thereof is such that less than about 30.0 percent by number of the toner particles have an average particle diameter of less than about 5 microns, about 25.0 percent by number of the toner particles have an average particle diameter of between about 8 microns and about 12 microns, and less than about 5.0 percent by number of the toner particles have an average particle diameter greater than about 20 microns. However, it is preferred that the particle size distribution be such that less than about 20 percent by number of the toner particles have an average particle diameter of less than about 5 microns, about 45 percent by number of the toner particles have an average particle diameter of between about 8 microns and about 12 microns, and less than about 5 percent by number of the toner particles have an average particle diameter greater than about 20 microns. Optimum results are obtained when the particle size distribution is such that less than about 10 percent by number of the toner particles have an average particle diameter of less than about 5 microns, about 60 percent by number of the toner particles have an average particle diameter of between about 8 microns and about 12 microns, and less than about 5 percent by number of the toner particles have an average particle diameter greater than about 20 microns.

Any suitable particle classification method may be employed to obtain the classified toner materials of this invention. Typical particle classification methods include air classification, screening, cyclone separation, elutriation, centrification, and combinations thereof. The preferred method of obtaining the classified toner materials of this invention is by centrifugal air classification. In this method, air or some other gas flows inwards in a spiral path through a flat, cylindrical chamber. Particles contained in the air flow are exposed to two antagonistic forces, viz., to the inwardly directed tractive force of the air, and to the outwardly directed centrifugal force of the particle. For a definite size of particles, that is, the "cut size," both forces are in equilibrium. Larger (heavier) particles are dominated by the mass-dependent centrifugal force and the smaller (lighter) particles by the frictional force proportional to the particle diameter. Consequently, the larger or heavier particles fly outwards as coarse fraction, while the smaller or lighter ones are carried inwards by the air as fine fraction. The "cut size" usually depends upon the gradient of the spiral, the peripheral component, and the absolute dimension of the classifying chamber. Adjustment of the "cut size" may be effected through variation of the two factors first mentioned, while the range of the "cut size" may be determined by the respective dimension of the classifying chamber. Satisfactory centrifugal air classification results may be obtained when employing an apparatus such as the Mikroplex® Spiral Air Classifier Type 132MP model available from the Alpine American Corporation, Natick, Massachusetts, or an Acucut® Model B18 unit available from the Donaldson Company, Inc., Tulsa, Okla.

Any suitable vinyl resin having a melting point of at least about 110° F. may be employed in the toner compositions. The vinyl resin may be a homopolymer or a copolymer of two or more vinyl monomers. Typical monomeric units which may be employed to form vinyl polymers include: styrene, p-chlorostyrene, vinyl napththalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2 chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinyl-idene chlorofluoride and the like; and N-vinyl compounds such as N-vinyl pyrrole, N-vinyl carbazole, N-vinyl indole, N-vinyl pyrrolidene and the like; and mixtures thereof. Generally, suitable vinyl resins employed in the toner have a weight average molecular weight between about 3,000 to about 500,000.

Toner resins containing relatively high percentages of a styrene resin are preferred. The presence of a styrene resin is preferred because a greater degree of image definition is generally achieved upon latent image development. Further, denser images are obtained when at least about 25 percent by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Thus, typical monometric materials which may be copolymerized with styrene by addition polymerization include: p-chlorostyrene, vinyl naphthalene; ethylenically unsaturated monoolefins such as theylene, propylene, butylene, isobuthlene and the like; vinyl esters such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like, vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyroole, N-vinyl carbazole, N-vinyl indole, N-vinyl pyrrolidene and the like; and mixtures thereof. The styrene resins may also be formed by the polymerization of mixtures of two or more of these unsaturated monomeric materials with a styrene monomer. The expression "addition polymerization" is intended to include known polymerization techniques such as free radical, anionic and cationic polymerization processes.

The vinyl resins, including styrene type reins, may also be blended with one or more other resins if desired. When the vinyl resin is blended with another resin, the added resin is preferably another vinyl resin because the resulting blend is characterized by especially good triboelectric stability and uniform resistance against physical degradation. The vinyl resins employed for blending with the styrene type or other vinyl resin may be prepared by the addition polymerization of any suitable vinyl monomer such as the vinyl monomers described above. Other thermoplastic resins may also be blended with the vinyl resins of this invention. Typical non-vinyl type thermoplastic resins include: rosin modified phenol formaldehyde resins, oil modified epoxy resins, polyurethane resins, cellulosic resins, polyether resins and mixture thereof. When the resin component of the toner contains styrene copolymerized with another unsaturated monomer or a blend of polystyrene and another resin, a styrene component of at least about 25 percent by weight based on the total weight of the resin present in the toner is preferred because denser images are obtained and a greater degree of image definition is achieved with a given quantity of toner material.

It is to be understood that the specific formulas given for the units contained in the resins of the toner materials represent the vast majority of the units present, but do not exclude the presence of monomeric units or reactants other than those which have been shown. For example, some commercial materials such as polystyrenes, and polychlorinated polyphenyl compounds contain trace amounts of homologues or unreacted or partially reacted monomers. Any minor amount of such substituents may be present in the materials of this invention.

Any suitable pigment or dye may be employed as the colorant for the toner particles. Toner colorants are well-known and include, for example, carbon black, nigrosine dye, aniline blue, Calco Oil Blue, chrome yellow, ultramarine blue, duPont Oil Red, Qunioline Yellow, emthylene blue chloride, phthalocyanine blue, Malachite Green Oxalate, lamp black, Rose Bengal and mixtures thereof. The pigment or dye should be present in the toner in a sufficient quantity to render it highly colored so that it will form a clearly visible image on a recording member. Thus, for example, where conventional electrostatographic copies of typed documents are desired, the toner may comprise a black pigment such as carbon black, for example, furnace black or channel black, or a black dye such as Amaplast Black dye, available from the National Aniline Products, Inc. Generally the pigment is employed in an amount from about 1 percent to about 20 percent by weight based on the total weight of the colored toner. If the toner colorant employed is a dye, substantially smaller quantities of colorant may be used. However, since a number of the above pigments used in electrostatographic toner compositions may affect both the glass transition and fusion temperatures of the toner compositions of this invention, their concentration preferably should be about 10 percent by weight of the colored toner.

The toner compositions may be prepared by any well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

Suitable coated and uncoated carrier materials for electrostatographic development are well-known in the art. The carrier particles comprise any suitable solid material, provided that the carrier particles acquire a charge having an opposite polarity to that of the toner particles when brought in close contact with the toner particles so that the toner particles adhere to and surround the carrier particles. When a positive reproduction of the electrostatic latent image is desired, the carrier particles are selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus, the materials for the carrier particles are selected in accordance with their triboelectric properties in respect to the electroscopic toner so that when mixed or brought into mutual contact, one component of the developer is charged positively if the other component is below the first component in the triboelectric series and negatively if the other component is above the first component in a triboelectric series. By proper selection of materials in accordance with their triboelectric effects, the polarities of their charge, when mixed, are such that the electroscopic toner particles adhere to and are coated on the surface of carrier particles and also adhere to the portion of the electrostatic image-bearing surface having a greater attraction for the toner than the carrier particles. Typical cascade development process carriers include sodium chloride, ammonium chloride, aluminum potassium chloride, Rochelle salt, sodium nitrate, aluminum nitrate, potassium chlorate, granular zircon, granular silicon, methyl methacrylate, glass, and silicon dioxide. Typical magnetic brush development process carriers include nickel, steel, iron, ferrites, and the like. The carriers may be employed with or without a coating. Many of the foregoing and other typical carriers are described by L. E. Walkup et al in U.S. Pat. No. 2,638,416 and E. N. Wise in U.S. Pat. No. 2,618,552. An ultimate coated carrier particle diameter between about 50 microns to about 1,000 microns is preferred because the carrier particles then possess sufficient density and inertia to avoid adherence to the electrostatic images during the cascade development process. For magnetic brush development, the carrier particles generally have an average diameter between about 50 microns and about 250 microns. Generally speaking, satisfactory results are obtained when about 1 part toner is used with about 10 to 200 parts by weight of carrier.

The classified toner materials of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,122,007 to Middleton, and U.S. Pat. No. 3,151,982 to Corrsin.

DESCRIPTION OF PREFERRED EMBODIMENTS

The following examples further define, describe, and compare methods of preparing the classified toner materials of the present invention and of utilizing them to develop electrostatic latent images. Parts and percentages are by weight unless otherwise indicated.

In the following examples, toner impaction is measured by a spectrophotometric technique. In general, a 3–5 gram sample of the developer is weighed accurately. Next it is washed with an aqueous surfactant solution to remove loose, non-impacted toner. A quantity of the appropriate solvent is added aimed at dissolving the impacted toner polymer and suspending the carbon black. The mixture of solution and suspended carbon black is ultra-sonified to disperse the carbon black. The resultant suspension is transferred to a volumetric flask and diluted with additional solvent to the mark. The apparent absorbance of the suspension is measured in the visible region. This is compared to a standard curve derived from the virgin toner used to prepare the developer. The concentration of impacted toner is calculated from the absorbance of the sample dispersion. Generally it has been found most useful to measure the rate of toner impaction throughout any machine test. For practical considerations, the number of measurements has to be limited and very good results have been obtained based upon toner impaction during the first 50,000 copies during any test. The rate of toner impaction is calculated from the milligrams of impacted toner polymer per gram of developer per 1,000 copies.

Further, in the following examples, the toner materials were classified employing an Acucut® Model B18 unit available from the Donaldson Company, Inc., Tulsa, Okla.

EXAMPLE I

A control sample of a toner composition comprising a mixture of about 90 parts by weight of a copolymer of about 58.0 percent by weight of styrene and about 42.0 percent by weight of n-butyl methacrylate, and about 10 parts by weight of a furnace carbon black was evaluated for performance in a magnetic brush development system. The toner particles were determined to have a particle size number distribution fine index of about 1.70, a particle size volume distribution coarse index of about 1.40, and a particle size distribution wherein about 50 percent of the toner particles had an average particle diameter of less than about 5 microns, about 23 percent by number of the toner particles had an average particle diameter of between about 5 microns and about 8 microns, about 15 percent by number of the toner particles had an average particle diameter of between about 8 microns and about 12 microns, about 7 percent by number of the toner particles had an average particle diameter of between about 12 microns and about 20 microns, and about 5 percent by number of the toner particles had an average particle diameter of more than 20 microns. About 1 part by weight of the toner particles was mixed with about 99 parts by weight of ferromagnetic coated carrier beads as disclosed in U.S. Pat. No. 3,526,533 to form a developer mixture. Copies of a standard test pattern were made with the developer mixture in an electrostatographic copying machine employing a magnetic brush development system. It was found that the developer mixture failed after about 100,000 copies. Developer failure was experienced in the form of high background, i.e., exceeding the specified 0.01 background density level at 1.0 solid area density. A high level of photoreceptor filming was observed as print-out on the copies occurred at a frequency of about every 15,000 copy intervals. The rate of toner impaction was found to be about 0.0450.

EXAMPLE II

The toner composition of Example I was evaluted for performance as in Example I except that the toner particles were determined to have a particle size number distribution fine index of about 2.07, a particle size volume distribution coarse index of about 1.40, and a particle size distribution wherein about 29 percent of the toner particles had an average particle diameter of less than about 5 microns, about 30 percent by number of the toner particles had an average particle diameter of between about 5 microns and about 8 microns, about 25 percent by number of the toner particles had an average particle diameter of between about 8 microns and about 12 microns, about 11 percent by number of the toner particles had an average particle diameter of between about 12 microns and about 20 microns, and about 5 percent by number of the toner particles had an average particle diameter of more than 20 microns. About 1 part by weight of the toner particles was mixed with about 99 parts by weight of ferromagnetic coated carrier beads as disclosed in U.S. Pat. No. 3,526,533 to form a developer mixture. Copies of a standard test pattern were made with the developer mixture in an electrostatographic copying machine employing a magnetic brush development system. It was found that the developer mixture performed satisfactorily up to about 225,000 copies. A lower level of photoreceptor filming was observed as print-out on the copies at a frequency of about every 25,000 copy intervals. The rate of toner impaction was found to be about 0.0280.

EXAMPLE III

The toner composition of Example I was evaluated for performance as in Example I except that the toner particles were determined to have a particle size number distribution fine index of about 2.60, a particle size volume distribution coarse index of about 1.35, and a particle size distribution wherein about 23 percent of the toner particles had an average particle diameter of less than about 5 microns, about 18 percent by number of the toner particles had an average particle diameter of between about 5 microns and about 8 microns, about 35 percent by number of the toner particles had an average particle diameter of between about 8 microns and about 12 microns, about 19 percent by number of the toner particles had an average particle diameter of between about 12 microns and about 20 microns, and about 5 percent by number of the toner particles had an average particle diameter of more than 20 microns. About 1 part by weight of the toner particles was mixed with about 99 parts by weight of ferromagnetic coated carrier beads as disclosed in U.S. Pat. No. 3,526,533 to form a developer mixture. Copies of a standard test pattern were made with the developer mixture in an electrostatographic copying machine employing a magnetic brush development system. It was found that the developer mixture performed satisfactorily up to about 375,000 copies. A lower level of photoreceptor filming was observed as print-out on the copies at a frequency of about every 35,000 copy intervals. The rate of toner impaction was found to be about 0.0220.

EXAMPLE IV

The toner composition of Example I was evaluated for performance as in Example I except that the toner particles were determined to have a particle size number distribution fine index of about 2.25, a particle size volume distribution coarse index of about 1.35, and a particle size distribution wherein about 21 percent of the toner particles had an average particle diameter of less than about 5 microns, about 15 percent by number of the toner particles had an average particle diameter of between about 5 microns and about 8 microns, about 40 percent by number of the toner particles had an average particle diameter of between about 8 microns and about 12 microns, about 19 percent by number of the toner particles had an average particle diameter of between about 12 microns and about 20 microns, and about 5 percent by number of the toner particles had an average particle diameter of more than 20 microns. About 1 part by weight of the toner particles was mixed with about 99 parts by weight of ferromagnetic coated carrier beads as disclosed in U.S. Pat. No. 3,526,533 to form a developer mixture. Copies of a standard test pattern were made with the developer mixture in an electrostatographic copying machine employing a magnetic brush development system. It was found that the developer mixture performed satisfactorily up to 325,000 copies when the test was suspended. A lower level of photoreceptor filming was observed as print-out on the copies at a frequency of about every 50,000 copy intervals. The rate of toner impaction was found to be about 0.0140.

EXAMPLE V

The toner composition of Example I was evaluated for performance as in Example I except that the toner particles were determined to have a particle size number distribution fine index of about 1.70, a particle size volume distribution coarse index of about 1.33, and a particle size distribution wherein about 13 percent of the toner particles had an average particle diameter of less than about 5 microns, about 12 percent by number of the toner particles had an average particle diameter of between about 5 microns and about 8 microns, about 50 percent by number of the toner particles had an average particle diameter of between about 8 microns and about 12 microns, about 20 percent by number of the toner particles had an average particle diameter of between about 12 microns and about 20 microns, and about 5 percent by number of the toner particles had an average particle diameter of more than 20 microns. About 1 part by weight of the toner particles was mixed with about 99 parts by weight of ferromagnetic coated carrier beads as disclosed in U.S. Pat. No. 3,526,533 to form a developer mixture. Copies of a standard test pattern were made with the developer mixture in an electrostatographic copying machine employing a magnetic brush development system. It was found that the developer mixture performed satisfactorily up to 400,000 copies when the test was suspended. A low level of photoreceptor filming was observed as print-out on the copies at a frequency of about every 135,000 copy intervals. The rate of toner impaction was found to be about 0.0117.

EXAMPLE VI

The toner composition of Example I was evaluated for performance as in Example I except that the toner particles were determined to have a particle size number distribution fine index of about 1.40, a particle size volume distribution coarse index of about 1.33, and a particle size distribution wherein about 8 percent of the toner particles had an average particle diameter of less than about 5 microns, about 8 percent by number of the toner particles had an average particle diameter of between about 5 microns and about 8 microns, about 55 percent by number of the toner particles had an average particle diameter of between about 8 microns and about 12 microns, about 24 percent by number of the toner particles had an average particle diameter of between about 12 microns and about 20 microns, and about 5 percent by number of the toner particles had an average particle diameter of more than 20 microns. About 1 part by weight of the toner particles was mixed with about 99 parts by weight of ferromagnetic coated carrier beads as disclosed in U.S. Pat. No. 3,526,533 to form a developer mixture. Copies of a standard test pattern were made with the developer mixture in an electrostatographic copying machine employing a magnetic brush development system. It was found that the developer mixture performed satisfactorily up to about 600,000 copies when the test was suspended. A very low level of photoreceptor filming was observed as print-out on the copies at a frequency of more than every 250,000 copy intervals. The rate of toner impaction was found to be about 0.0074.

The classified toner materials of this invention are further characterized as being more resistant to agglomeration resulting in improved dispensing characteristics and machine performance with longer systems life. The classified toner materials of the invention are still further characterized as experiencing substantially reduced impaction rates resulting in more stable triboelectric charging properties of the developer mixtures for substantially longer periods of time thereby increasing the developer life of the developer mixtures and decreasing the time intervals between replacement of the developer materials. In addition, the classified toner materials of this invention may be further characterized as being more resistant to formation of scum and film on electrostatographic recording surfaces thereby generating less undesirable materials onto the recording surfaces with greater ease of cleanability and maintenance thereof and providing longer systems life. Further still, the classified toner materials of this invention may be characterized as possessing improved electrical and mechanical properties providing dense toner images and are particularly useful in magnetic brush development systems. Thus, by providing the classified toner materials of this invention, substantial improvements in systems life due to limited photoreceptor filming and longer intrinsic developer life result upon the classification of toner materials and especially upon the substantial removal of toner fines, that is, toner particles having an average particle diameter of less than about 5 microns. Although applicants do not wish to be bound by any theory for the improved results obtained with the classified toner materials of this invention, it appears that the smaller toner particles are held with a greater force to the surface of the carrier particles and consequently consume more of the effective surface area thereof more rapidly than the larger toner particles. In addition, photoreceptor filming by smaller toner particles which results in print-out on subsequent copies and is a major limitation on systems life has been substantially reduced. Applicants have found that removal of the smaller toner particles substantially reduces the incidence of photoreceptor filming or scumming.

The expressions "developing material" and "developer mixture" as employed herein are intended to include toner material or combinations of toner material and carrier material.

Although specific materials and conditions are set forth in the foregoing examples, these are merely intended as illustrations of the present invention. Various other suitable toner resins, additives and other components, such as those listed above, may be substituted for those in the example with similar results. Other materials such as wetting agents may be added to the toner to sensitize, synergize or otherwise improve the fusing properties or other desirable properties of the system, such as, for example, modification of triboelectric properties.

Other modifications of the present invention will occur to those skilled in the art upon a reading of the present invention. These are intended to be included within the scope of this invention.

What is claimed is:

1. An electrostatographic toner material for a high-speed magnetic brush development copying and/or duplicating device comprising toner particles classified as to particle size wherein the improvement comprises said toner particles have a particle size number distribution fine index ratio of less than about 2.50, a particle size volume distribution coarse index ratio of less than about 1.50, a particle size distribution wherein less than about 30.0 percent by number of the particles have an average particle size diameter of less than about 5 microns, about 25 percent by number of the particles have a diameter between about 8 microns and about 12 microns, and less than about 5 percent by number of the toner particles have an average particle diameter greater than about 20 microns, said toner particles being further characterized as providing improved copy quality, lower rate of photoreceptor filming, and lower rate of impaction in an electrostatographic development system.

2. An electrostatographic toner material according to claim 1 wherein said particle size number distribution fine index is less than about 2.00.

3. An electrostatographic toner material according to claim 1 wherein said particle size number distribution fine index is less than about 1.45.

4. An electrostatographic toner material according to claim 1 wherein said particle size volume distribution coarse index is less than about 1.45.

5. An electrostatographic toner material according to claim 1 wherein said particle size volume distribution coarse index is less than about 1.35.

6. An electrostatographic toner material according to claim 1 wherein said toner material comprises a mixture of about 90 parts by weight of a copolymer of about 58.0 percent by weight of styrene, about 42.0 percent by weight of n-butyl methacrylate, and about 10 parts by weight of a furnace carbon black.

7. An electrostatographic toner material for a high-speed magnetic brush development copying and/or duplicating device comprising toner particles classified as to particle size wherein the improvement comprises said toner particles have a particle size number distribution fine index ratio of less than about 2.50, a particle size volume distribution coarse index ratio of less than about 1.50, a particle size distribution wherein less than about 20 percent by number of the toner particles have an average particle diameter of less than about 5 microns, about 45 percent by number of the particles have an average particle diameter of between about 8 microns and about 12 microns, and less than about 5 percent by number of the toner particles have an average particle diameter greater than about 20 microns, said toner particles being further characterized as providing improved copy quality, lower rate of photoreceptor filming, and lower rate of impaction in an electrostatographic development system.

8. An electrostatographic toner material for a high-speed magnetic brush development copying and/or duplicating device comprising toner particles classified as to particle size wherein the improvement comprises said toner particles have a particle size number distribution fine index ratio of less than about 2.50, a particle size volume distribution coarse index ratio of less than about 1.50, a particle size distribution wherein less than about 10 percent by number of the toner particles have an average particle diameter of less than about 5 microns, about 60 percent by number of the toner particles have an average particle diameter of between about 8 microns and about 12 microns, and less than about 5 percent by number of the toner particles have an average particle diameter greater than about 20 microns, said toner particles being further characterized as providing improved copy quality, lower rate of photoreceptor filming, and lower rate of impaction in an electrostatographic development system.

9. An electrostatographic developer mixture for a high-speed magnetic brush development copying and/or duplicating device comprising finely divided toner particles electrostatically clinging to the surface of carrier particles, said toner particles comprising an electrostatographic toner material wherein the improvement comprises said toner particles are classified as to particle size and have a particle size number distribution fine index ratio of less than about 2.50, a particle size volume distribution coarse index ratio less than about 1.50, and a particle size distribution wherein less than about 30.0 percent by number of the particles have an average particle size diameter of less than about 5 microns, about 25 percent by number of the particles have a diameter between about 8 microns and about 12 microns, and less than about 5 percent by number of the toner particles have an average particle diameter greater than about 20 microns, said toner particles being further characterized as providing improved copy quality, lower rate of photoreceptor filming, and lower rate of impaction in an electrostatographic development system.

10. An electrostatographic developer mixture according to claim 9 wherein said particle size number distribution fine index is less than about 2.00.

11. An electrostatographic developer mixture according to claim 9 wherein said particle size number distribution fine index is less than about 1.45.

12. An electrostatographic developer mixture according to claim 9 wherein said particle size volume distribution coarse index is less than about 1.45.

13. An electrostatographic developer mixture according to claim 9 wherein said particle size volume distribution coarse index is less than about 1.35.

14. An electrostatographic developer mixture according to claim 9 wherein said toner material comprises a mixture of about 90 parts by weight of a copolymer of about 58.0 percent by weight of styrene, about 42.0 percent by weight of n-butyl methacrylate, and about 10 parts by weight of a furnace carbon black.

15. An electrostatographic developer mixture for a high-speed magnetic brush development copying and/or duplicating device comprising finely divided toner particles electrostatically clinging to the surface of carrier particles, said toner particles comprising an electrostatographic toner material wherein the improvement comprises said toner particles are classified as to particle size and have a particle size number distribution fine index ratio of less than about 2.50, a particle size volume distribution coarse index ratio less than about 1.50, and a particle size distribution wherein less than about 20 percent by number of the toner particles have an average particle diameter of less than about 5 microns, about 45 percent by number of the toner particles have an average particle diameter of between about 8 microns and about 12 microns, and less than about 5 percent by number of the toner particles have an average particle diamter greater than about 20 microns, said toner particles being further characterized as providing improved copy quality, lower rate of photoreceptor filming, and lower rate of impaction in an electrostatographic development system.

16. An electrostatographic developer mixture for a high-speed magnetic brush development copying and/or duplicating device comprising finely divided toner particles electrostatically clinging to the surface of carrier particles, said toner particles comprising an electrostatographic toner material wherein the improvement comprises said toner particles are classified as to particle size and have a particle size number distribution fine index ratio of less than about 2.50, a particle size volume disbution coarse index ratio less than about 1.50, and a particle size distribution wherein less than about 10 percent by number of the toner particles have an average particle diameter of less than about 5 microns, about 60 percent by number of the toner particles have an average particle diameter of between about 8 microns and about 12 microns, and less than about 5 percent by number of the toner particles have an average diameter greater than about 20 microns, said toner particles being further characterized as providing improved copy quality, lower rate of photoreceptor filming, and lower rate of impaction in an electrostatographic development system.

* * * * *